US008207678B1

(12) United States Patent
Mika et al.

(10) Patent No.: US 8,207,678 B1
(45) Date of Patent: Jun. 26, 2012

(54) LED LIGHTING FIXTURE

(75) Inventors: Jason R. Mika, Austin, TX (US); Christopher Varrin, Los Gatos, CA (US); Jeremy R. Hochman, Austin, TX (US); Matthew E. Ward, Philadelphia, PA (US)

(73) Assignee: Barco, Inc., Duluth, GA (US)

( * ) Notice: Subject to any disclaimer, the term of this patent is extended or adjusted under 35 U.S.C. 154(b) by 712 days.

(21) Appl. No.: 12/074,969

(22) Filed: Mar. 7, 2008

Related U.S. Application Data

(60) Provisional application No. 60/894,117, filed on Mar. 9, 2007.

(51) Int. Cl.
*H05B 37/02* (2006.01)

(52) U.S. Cl. ..... 315/291; 315/250; 315/312

(58) Field of Classification Search ..... 315/178–184, 315/185 R, 185 S, 250, 291, 294, 297, 312; 362/227, 564–566, 640, 644, 652–654, 806
See application file for complete search history.

(56) References Cited

U.S. PATENT DOCUMENTS

| | | | | |
|---|---|---|---|---|
| 5,300,864 | A * | 4/1994 | Allen, Jr. | 315/314 |
| 6,072,280 | A * | 6/2000 | Allen | 315/185 S |
| 6,472,823 | B2 | 10/2002 | Yen | |
| 6,676,284 | B1 | 1/2004 | Willson | |
| 6,857,924 | B2 | 2/2005 | Fu et al. | |
| 6,860,007 | B1 | 3/2005 | Liu et al. | |
| 7,053,557 | B2 | 5/2006 | Cross et al. | |
| 7,067,992 | B2 | 6/2006 | Leong et al. | |
| 7,329,024 | B2 * | 2/2008 | Lynch et al. | 362/240 |
| 7,377,802 | B2 * | 5/2008 | Allen | 439/490 |
| 7,401,946 | B2 * | 7/2008 | Laukhuf | 362/270 |
| 7,489,086 | B2 * | 2/2009 | Miskin et al. | 315/185 R |
| 7,737,643 | B2 * | 6/2010 | Lys | 315/291 |
| 2002/0012258 | A1 * | 1/2002 | Nagai et al. | 363/95 |
| 2004/0141293 | A1 * | 7/2004 | Chun | 361/715 |
| 2007/0153517 | A1 * | 7/2007 | Sloan et al. | 362/240 |
| 2007/0217209 | A1 * | 9/2007 | Wong | 362/418 |

* cited by examiner

*Primary Examiner* — Tung X Le
(74) *Attorney, Agent, or Firm* — Aka Chan LLP

(57) ABSTRACT

An LED lighting system includes a power supply module, a data input line routed through the power supply module, an AC power input, and an LED fixture. The power supply module includes a power supply unit and an AC power cable. The AC power input is electrically connected to the power supply unit and the AC power cable. The LED fixture is electrically connected to an output of the power supply unit and the data input cable, and includes one or more LED assemblies disposed on a circuit board, a data signal output, and a power output. The AC power cable may be routed through the LED fixture.

30 Claims, 8 Drawing Sheets

LED LIGHTING FIXTURE

CROSS-REFERENCE TO RELATED APPLICATIONS

This application, pursuant to 35 U.S.C. §119(e), claims priority to U.S. Patent Application Ser. No. 60/894,117 filed on Mar. 9, 2007 and entitled "LED Lighting Fixture," which is hereby incorporated by reference in its entirety.

BACKGROUND

1. Field of Disclosure

Embodiments disclosed herein generally relate to lighting systems. More specifically, embodiments disclosed herein relate to an improved system and method for distributing power and data signals in a lighting system.

2. Background of Invention

Display units for entertainment, architectural, and advertising purposes have commonly been constructed from numbers of light emitting elements, such as light emitting diodes ("LEDs") or incandescent lamps. The light emitting elements may be selectively turned on and off to create patterns, graphics, and video displays for both informational and aesthetic purposes. It is well known to construct tubular lighting and display devices using LEDs and various methods have been used for distributing data and power signals through such devices.

U.S. Pat. No. 6,472,823, issued to George Yen, uses a daisy-chain system where control and power enters one end of a tube fixture, is carried through the tube, and leaves the other end to connect to the next fixture. The power supply is at one end of the chain so that the system may be limited by the number of tubes that are connected in the chain by the capacity of that power supply. U.S. Pat. No. 6,857,924, issued to Ta-Hao Fu, and U.S. Pat. No. 6,860,007, issued to Li-wen Liu, are also similarly used.

U.S. Pat. No. 7,053,557, issued to Robert Cross, describes supplying power in parallel to multiple LED tube fixtures but does not disclose doing so in a way that allows multiple power supplies to be used or means to economically distribute and protect the cabling systems. In addition the low voltage power supplies are contained within the tube where heat management could be problematic.

U.S. Pat. No. 7,067,992, issued to Susan Leong, describes another method for connecting power to an LED tube fixture but does not explain how data signals may also be connected.

U.S. Pat. No. 6,676,284, issued to Wynne Willson, describes an LED tube fixture system with multiple power supplies and a data signal path but does not teach means for connecting the power supplies and routing the cables to minimize fixture size.

LED tube fixtures of this type are often used in architectural situations where it is a requirement to maintain a clean and tidy appearance for the fixture with hidden cabling and seamless joins between fixtures. Another requirement is that the power supplies are mounted in such a way that access for installation and maintenance is simple. Finally, it would be advantageous to provide protection for power and data cabling without the need to run separate cable conduits or trunking adjacent to the fixtures.

This invention seeks to provide means for distributing power and data signals in an LED lighting or display fixture that may minimize the size of the fixture and eliminate the need to run alternating current ("AC") power in a separate cable alongside the fixture.

SUMMARY OF THE INVENTION

In one aspect of one or more embodiments, an LED lighting system includes a power supply module, a data input line routed through the power supply module, an AC power input, and an LED fixture. The power supply module includes a power supply unit and an AC power cable. The AC power input is electrically connected to the power supply unit and the AC power cable. The LED fixture is electrically connected to an output of the power supply unit and the data input cable, and includes one or more LED assemblies disposed on a circuit board, a data signal output, and a power output. The AC power cable may be routed through the LED fixture.

In another aspect of one or more embodiments, a method of transmitting data and power within an LED lighting system includes receiving an AC power input and a data input signal at a power supply module, splitting the AC power input into an AC power cable and an AC power signal, connecting the AC power signal to a power supply unit disposed within the power supply module, generating a low voltage power signal from the AC power signal with the power supply unit, connecting the AC power cable, the low voltage power signal, and the data input signal to an LED fixture, receiving the low voltage power signal and the data input signal at a circuit board disposed within the LED fixture, wherein the circuit board comprises an LED assembly disposed thereon, and powering and controlling the LED assembly with the low voltage power signal and the data signal.

In yet another aspect of one or more embodiments, a method of transmitting data and power within an LED lighting system includes receiving an AC power input, a low voltage power signal, and a data signal at a power supply module, connecting the AC power input and the low voltage power signal to a power supply unit disposed within the power supply module, splitting the AC power input into an AC power cable and an AC power signal, powering the power supply unit with the AC power signal, amplifying the low voltage power signal with the power supply unit, connecting the AC power cable, the low voltage power signal, and the data signal to an LED fixture, receiving the low voltage power signal and the data signal at a circuit board disposed within the LED fixture, wherein the circuit board comprises an LED assembly disposed thereon, and powering and controlling the LED assembly with the low voltage power signal and the data signal.

Further, in yet another aspect of one or more embodiments, an LED lighting system includes a first LED fixture electrically connected to a low voltage power input and a data signal input, a power supply module, and a second LED fixture. The first LED fixture includes a first AC power cable routed through the first LED fixture, thereby providing a first AC power output, a first low voltage power output, and a first data signal output. The power supply module includes a power supply unit electrically connected to the first AC power output, and provides a second low voltage power output, a second AC power cable electrically connected to the first AC power output, thereby providing a second AC power output, and a data input line electrically connected to the first data signal output and routed through the power supply module, thereby providing a second data signal output. The second LED fixture is electrically connected to the second low voltage power output and the second data signal output and includes a third AC power cable electrically connected to the second AC power output and routed through the second LED fixture, thereby providing a third AC power output, a third low voltage power output, and a third data signal output.

Other aspects and advantages of the present disclosure will be apparent from the following description and the appended claims.

DETAILED DESCRIPTION

Figure 1:
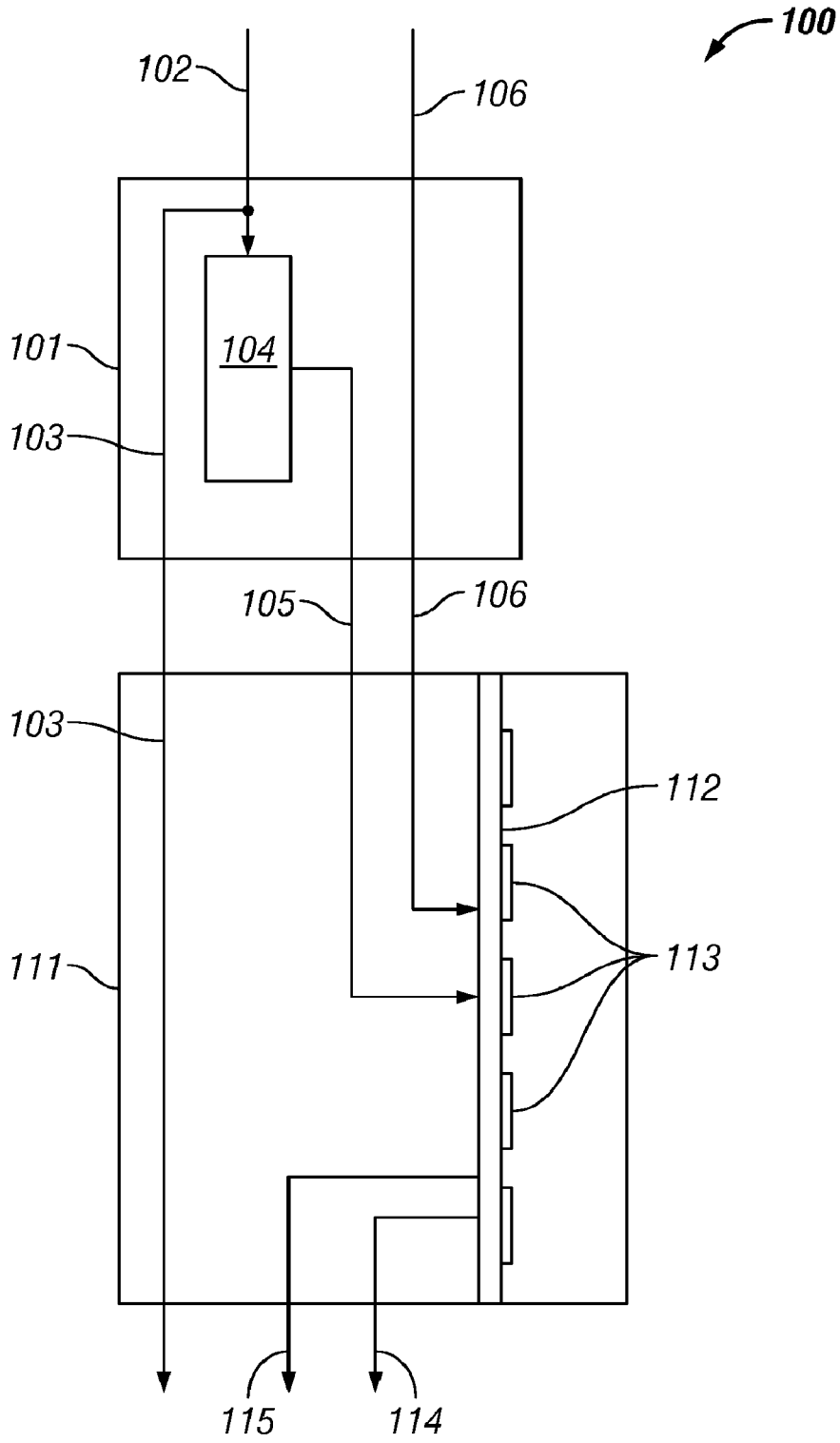
FIG. 1 is a block diagram of an LED light system in accordance with embodiments disclosed herein.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Embodiments of the claimed invention are directed towards a light emitting diode ("LED") light system that eliminates the necessity for separate power and data cables being run alongside the system. The LED light system may include LED fixtures and power supply modules. The LED fixtures serve to actually generate light to create patterns, graphics, and video displays for both informational and aesthetic purposes, whereas the power supply modules serve as a stable source of power for LED fixtures. Generally, there is a main source of alternating current ("AC") power for the entire LED light system, but each of the LED fixtures may run on a low voltage DC power signal. Embodiments of the claimed invention may allow a cable carrying AC power to route through the LED light system itself in order to keep the cable out of sight. Data signal cables and low voltage supply cables may also be similarly routed through the system.

Referring to FIG. 1, a block diagram of an LED light system 100 in accordance with embodiments disclosed herein is shown. The system 100 includes an LED fixture 111 and a power supply module 101. The power supply module 101 includes an AC power input 102 and a data signal line 106 as inputs. Within the power supply module 101, an AC power input 102 may be split between an AC power signal and an AC power cable 103. The AC power signal is electrically connected to a power supply unit 104, also contained within the power supply module 101.

After being split from the AC power input 102, the AC power cable 103 is then routed through the LED fixture 111 exiting as AC power 103. AC power cable 103 may be insulated within the LED fixture 111, but LED fixture 111 provides routing and protection for the AC power cable 103. Further, within the LED fixture 111, AC power cable 103 may be electrically isolated and separated from low voltage areas and cables using internal barriers within the LED fixture 111 or using insulation on AC power cable 103.

The data signal line 106 passes through the power supply module 101, exits the module, and connects to the LED fixture 111. In this embodiment, the data signal line 106 is insulated, or isolated, from the power supply module 101, but power supply module 101 provides routing and protection for the data signal line 106. In an alternate embodiment, not shown in the figures, the data signal line 106 may connect to the power supply module 101. In this case, the power supply module 101 may amplify, or boost, a data signal transmitted on the data signal line 106. In this embodiment data signal line 106 would not be an output, and there would be an additional data signal output from the power supply module 101 that may be transmitted to either a second power supply module or the LED fixture 111.

The power supply unit 104 accepts the AC power signal split from the AC power input 102, and generates a low voltage supply signal 105. The low voltage supply signal 105 may, for example, be a DC power supply signal suitable for driving the LED fixture 111. The power supply signals suitable for directly driving the LED fixture 111 are generally not suitable for being transmitted over long distances. Thus, the power supply unit 104 serves to refresh the low voltage supply signal for use in the subsequent LED fixture 111.

LED fixture 111 accepts an AC power cable 103, low voltage supply signal 105, and data signal line 106 as inputs. As discussed above, the AC power cable 103 may be insulated from other components and pass straight through the LED fixture 111 to be used in further modules. The LED fixture 111 further includes a circuit board 112 and LED assemblies 113. The LED assemblies 113 may include individual LEDs or arrays of LEDs. Further, each individual LED may be a typical light emitting diode, a polymer light emitting diode ("PLED"), an organic light emitting diode ("OLED"), or any other LED known in the art. The LED fixture may include, for example, an extrusion LED tube fixture, or any other LED fixture known in the art.

The circuit board 112 and LED assemblies 113 may be powered by the low voltage supply input 105 to produce light controlled based on information transmitted over the data signal line 106. Hence, the circuit board 112 and LED assemblies 113 serve to display light from the LED lighting system 100. Outputs from the LED fixture 111 include the AC power cable 103, data signal output 114, and low voltage supply output 115. While the data signal output 114 and low voltage supply output 115 are shown to originate from the circuit board 112, the outputs 114, 115 may also be tied directly to the corresponding inputs 106, 105.

Figure 2:
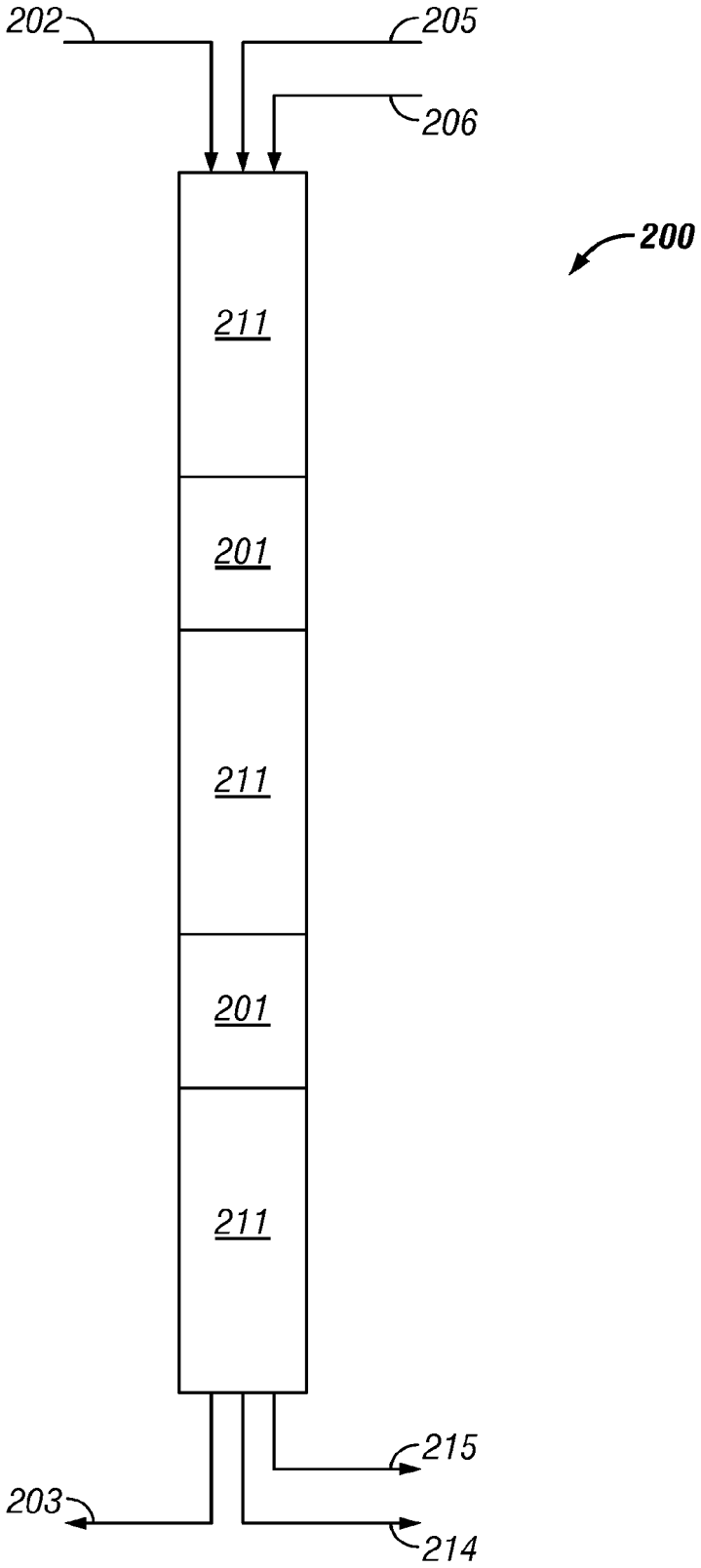
FIG. 2 is a block diagram of an LED light system in accordance with embodiments disclosed herein.

Referring to FIG. 2, a block diagram of an LED light system 200 in accordance with embodiments disclosed herein is shown. In this arrangement, three LED fixtures 211 are connected in series with two power supply modules 201 therebetween. This arrangement may be used to refresh the low voltage supply inputs for each of the LED fixtures 211. Inputs to the topmost LED fixture include an AC power input 202, data signal line 205, and a low voltage supply input 206.

Subsequently, the outputs from the topmost LED fixture are fed directly into the topmost power supply module through a connection between the two. A power supply module 201 may then refresh the low voltage supply power for the next LED fixture in the series, using the AC power cable routed through the previous LED fixture for power.

Alternatively, multiple LED fixtures 211 may be connected together in series between power supply modules 201. However, the length such a series of LED fixtures 211 is limited based on the power supplied by the original AC power input 202 and the power consumed in each of the LED fixtures 211. The number of fixtures between power supply modules 201 may be similarly limited based on the low voltage supply power. The final LED fixture 211 shows an AC power cable output 203, a data signal line output 214, and a low voltage supply signal output 215. These outputs may be used to drive further power supply modules 201 or LED fixtures 211. However, if the LED fixture is the last in a chain, they may not be used at all, and the connections may be terminated.

Figure 3:
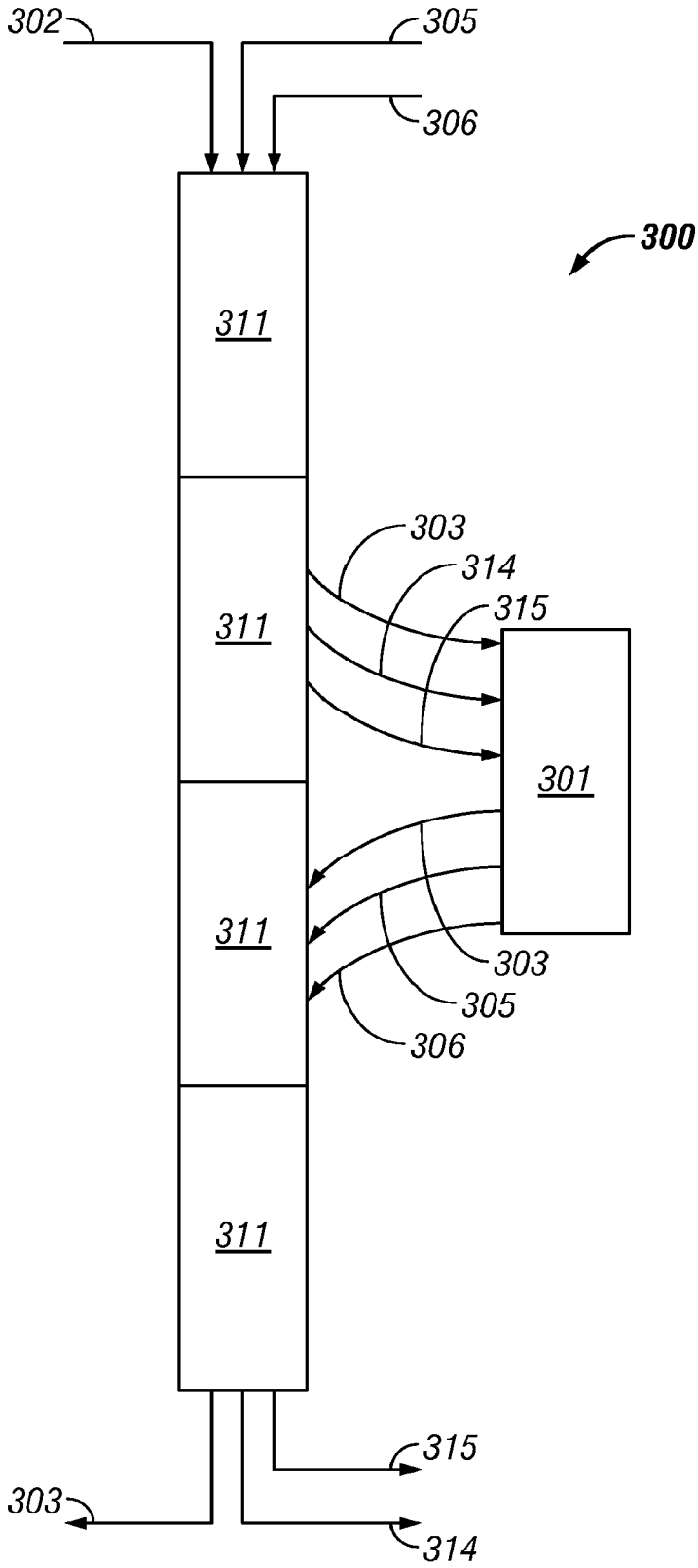
FIG. 3 is a block diagram of an LED light system in accordance with embodiments disclosed herein.

Referring to FIG. 3, a block diagram of an LED light system 300 in accordance with embodiments disclosed herein is shown. In this arrangement, four LED fixtures 311 are connected in series with a single power supply module 301 in parallel. This arrangement may be used to refresh the low voltage supply inputs for each of the bottom two LED fixtures 311. Inputs to the topmost LED fixture include an AC power input 302, data signal line 305, and a low voltage supply input 306. Each of the four LED fixtures are directly connected to the next in the series. External connections for the AC power cable 303, the data signal line output 314, and the low voltage supply output 315 are disposed on the second LED fixture from the top to connect to the power supply module 301. The power supply module 301 may then refresh the low voltage supply input 305 that is in turn fed into the third LED fixture from the top, as well as AC cable 303 and data signal line input 306.

The final LED fixture 311 shows an AC power cable output 303, a data signal line output 314, and a low voltage supply signal output 315. These outputs may be used to drive further power supply modules 301 or LED fixtures 311. However, if the LED fixture is the last in a chain, they may not be used at all, and the connections may be terminated.

Advantageously, this arrangement allows power supply modules 311 to be placed along the series of LED fixtures 301 as often as necessary. For example, the power provided may be sufficient for a chain of three or more LED fixtures 301 to be connected in series before an external power supply module 311 is needed to refresh the low voltage supply. As discussed above, this is limited by the AC power input, the power drawn from the LED fixtures, and any undesired power dissipation.

Figure 4:
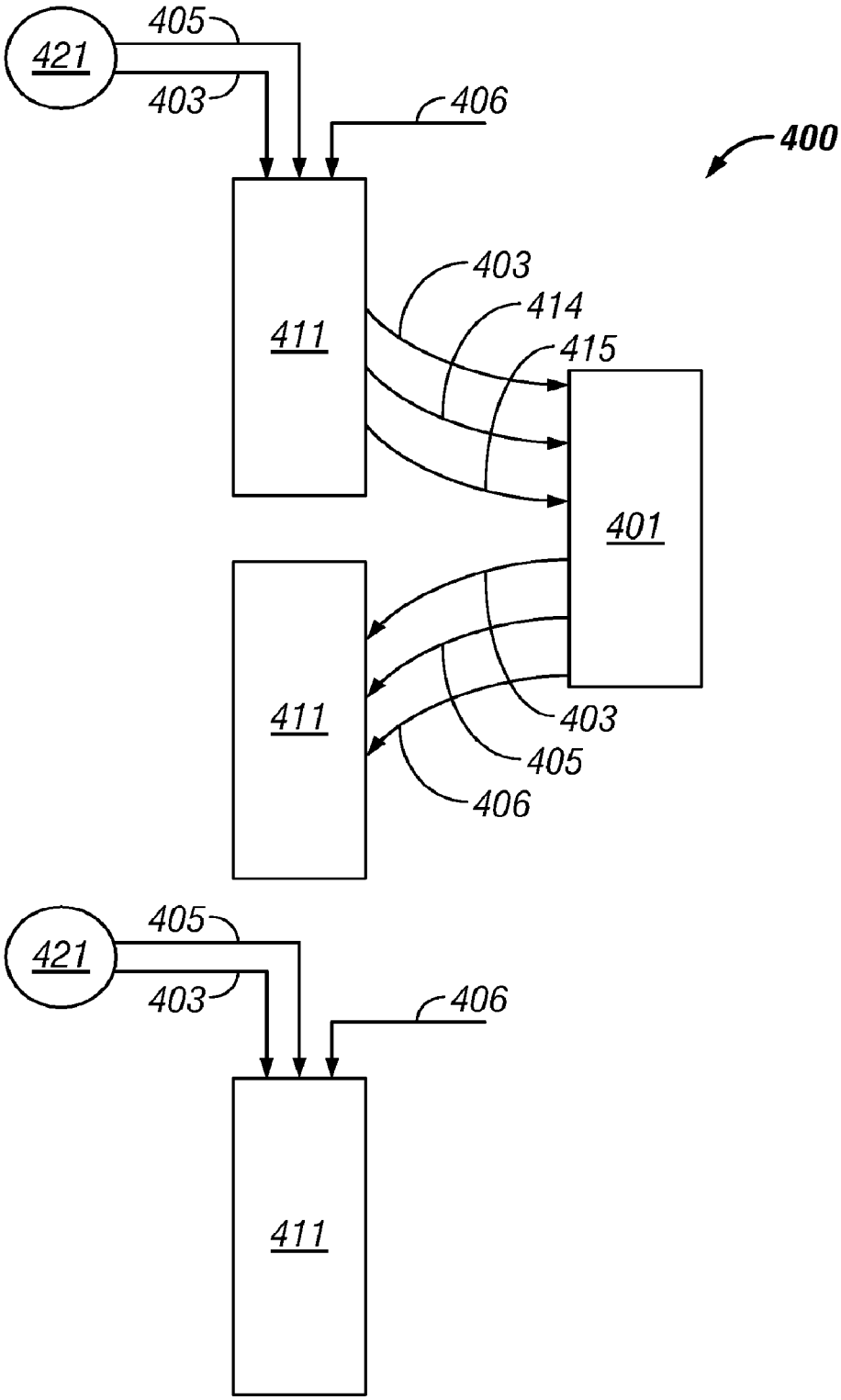
FIG. 4 is a block diagram of an LED light system in accordance with embodiments disclosed herein.

Referring to FIG. 4, a block signal and power flow diagram that includes features to isolate an LED lighting system 400 at the points where the system connects to house power is shown. At the start a LED fixtures 411 is a connection between the LED fixtures 411 and a house power distribution point 421. These power distribution points 421 may be inserted as often as desired. In some cases, it may be desirable to use frequent power distribution points to minimize the impact of failure by any single distribution point. In this example, the first house power distribution point 421 powers two LED fixtures 411, with one power supply module 401 to refresh the low voltage supply input to the second LED fixture 411. A second house power distribution point 422 powers a new series of LED fixtures below. At any point in a series, an additional house power distribution point may be added. A transformer may be included within a house power distribution point so as to supply both the AC power input 403 and the low voltage supply input 405.

Figure 5:
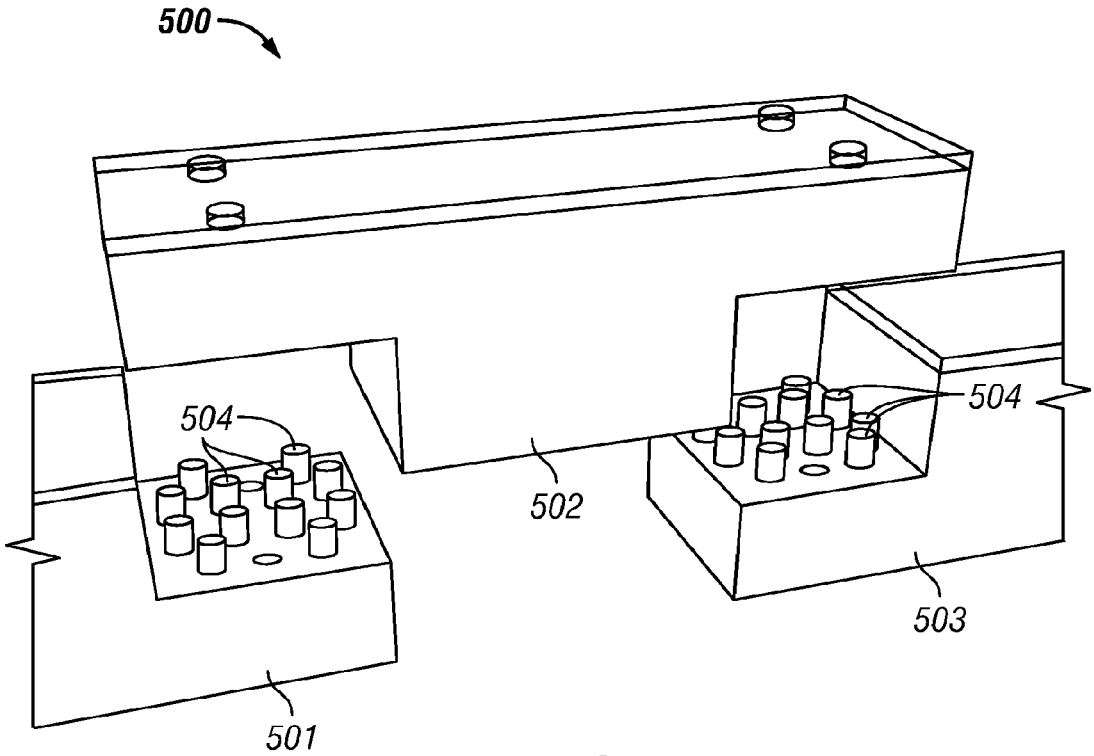
FIG. 5 shows a perspective view of an LED light system in accordance with embodiments disclosed herein.

Referring to FIG. 5, a perspective view of an LED lighting system 500 in accordance with embodiments disclosed herein are shown. LED fixtures 501, 503 are connected to power supply module 502 at each end through connections 504. Alternatively, each of the sections 501, 502, and 503 may comprise either a LED fixture or a power supply module. Connections 504 may include, but are not limited to the AC power inputs or outputs, data signal line inputs or outputs, and low voltage supply signal inputs or outputs, as discussed above with respect to various other embodiments disclosed herein. Further, connections capable of mating with connections 504 may be included on the end portions of power supply module 502. Advantageously, using the housings and connections shown, the connections between various modules may be completely hidden from view.

Figure 6:
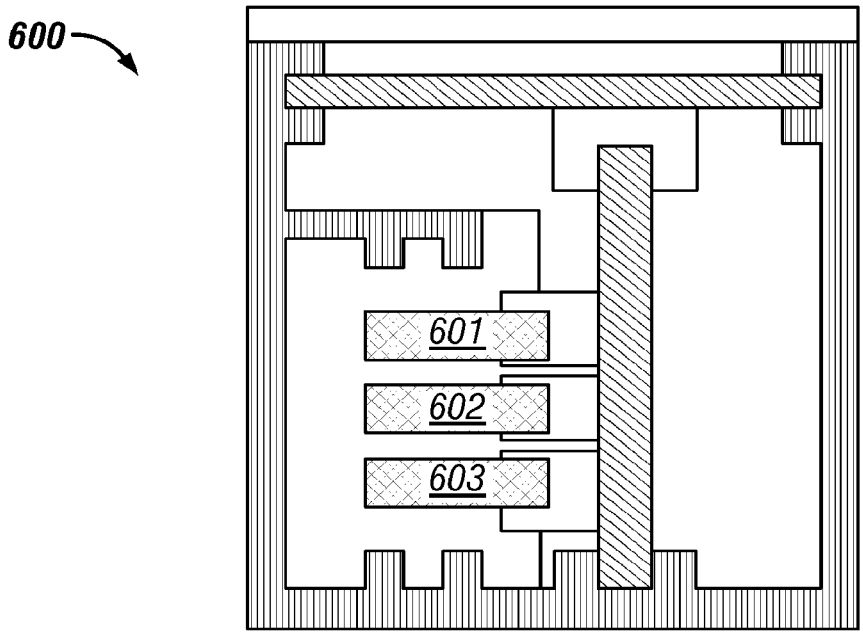
FIG. 6 shows a top view of a connector used in accordance with embodiments disclosed herein.
Figure 7:
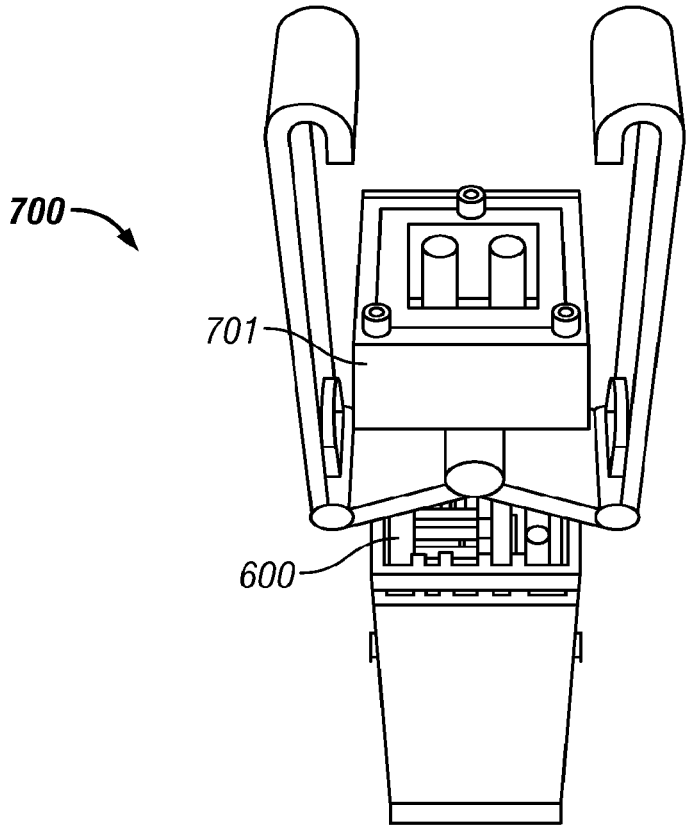
FIG. 7 shows a perspective view of a connection used in accordance with embodiments disclosed herein.
Figure 8:
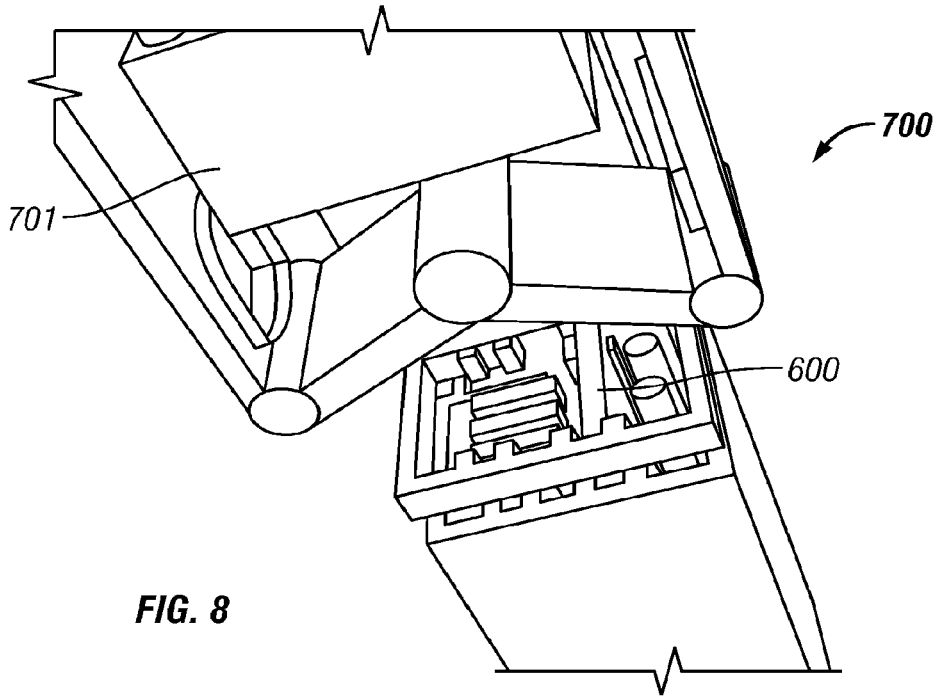
FIG. 8 shows a perspective view of a connection used in accordance with embodiments disclosed herein.
Figure 9:
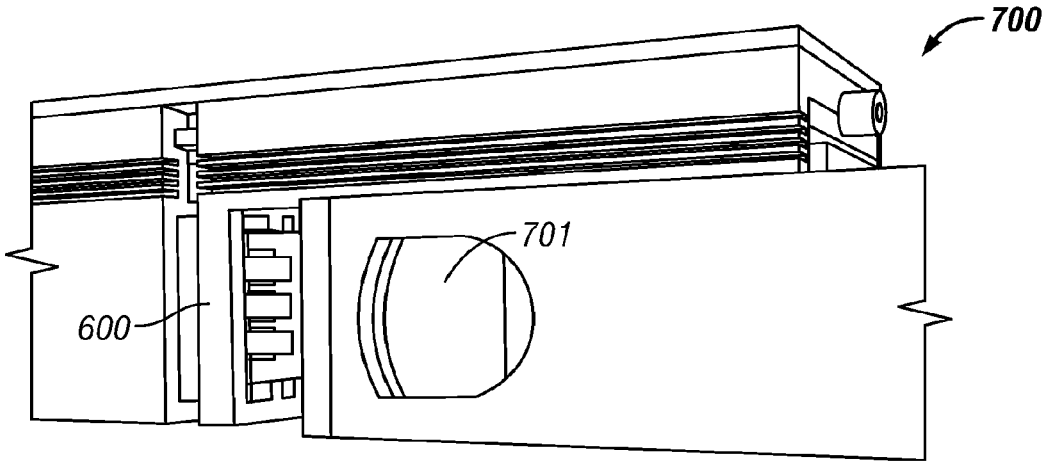
FIG. 9 shows a perspective view of a connection used in accordance with embodiments disclosed herein.

Referring to FIG. 6, an end view of a first mating connection 600 used in accordance with embodiments disclosed herein is shown. The mating connection 600 includes contact points 601, 602, and 603, for positive, ground, and negative connections. Referring to FIG. 7, a perspective view of a connection within a LED lighting system 700 shows a second mating connection 701 connecting to first mating connection 600 in accordance with embodiments disclosed herein. First mating connection 600 and second mating connection 701 are capable of joining to form electrical connections. These electrical connections may include, but are not limited to the AC power inputs or outputs, data signal line inputs or outputs, and low voltage supply signal inputs or outputs, as discussed above with respect to various other embodiments disclosed herein. Further, first and second mating connections 600, 701 may be examples of the connections 504 shown in FIG. 5. Finally, referring to FIGS. 8 and 9, two alternative perspective views of the connection within a LED lighting system 700 show a first mating connection 600 mating with a second mating connection 701 as they are used in accordance with embodiments disclosed herein.

Figure 10:
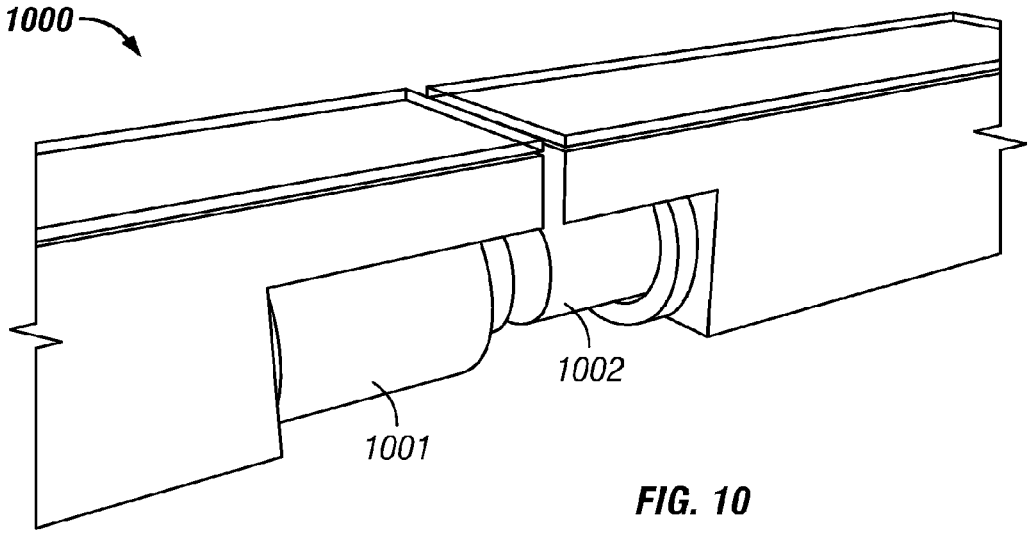
FIG. 10 shows a perspective view of a connection used in accordance with embodiments disclosed herein.
Figure 11:
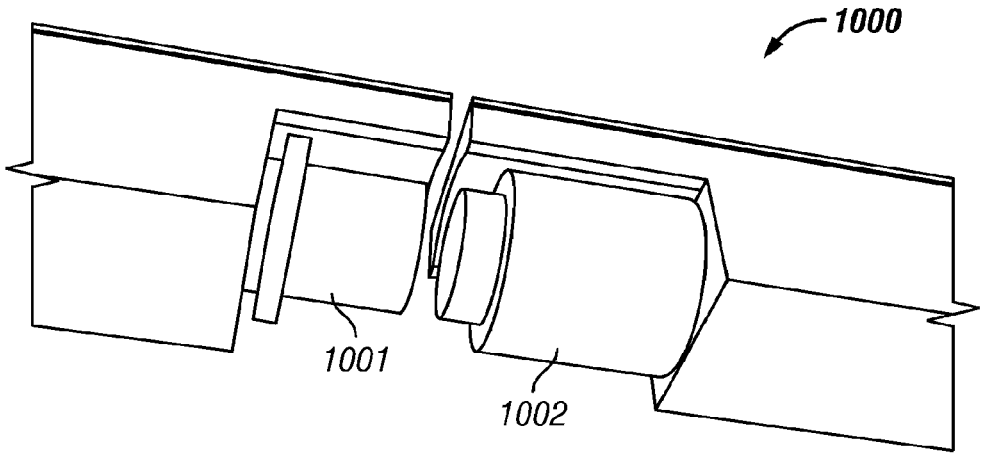
FIG. 11 shows a perspective view of a connection used in accordance with embodiments disclosed herein.

Referring to FIGS. 10 and 11, two perspective views of an LED lighting system 1000 show a first mating connection 1001 mating with a second mating connection 1002 as they are used in accordance with embodiments disclosed herein. First and second mating connections 1001, 1002 are alternative embodiments of the first and second mating connections 600, 701 discussed above with respect to FIGS. 6-9. First mating connection 1001 and second mating connection 1002 are capable of joining to form electrical connections. These electrical connections may include, but are not limited to the AC power inputs or outputs, data signal line inputs or outputs, and low voltage supply signal inputs or outputs, as discussed above with respect to various other embodiments disclosed herein. Further, first and second mating connections 1001, 1002 may be examples of the connections 504 shown in FIG. 5.

Embodiments disclosed herein may provide for one or more of the following advantages. First, the present disclosure may provide for an LED lighting system that does not require that separate data or power cables be run alongside the system. Because the system is directed towards displaying patterns, graphics, and video displays for both informational and aesthetic purposes, keeping data and power cables out of sight may provide for a better visual experience. Next, the present disclosure may provide for protection of data and power cables, because the data and power cables are run through the housing of the system itself. Finally, the present disclosure may provide for minimizing the number of power supply modules in an LED lighting system, because the embodiments disclosed herein allow for power supply modules to be inserted between, or alongside, LED fixtures as often as necessary.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A method of transmitting data and power within an LED lighting system, the method comprising:

receiving an AC power input and a data input signal at a power supply module;

within the power supply module, splitting the AC power input into an AC power cable and an AC power signal;

connecting the AC power signal to a power supply unit disposed within the power supply module;

generating a low voltage power signal from the AC power signal with the power supply unit;

connecting the AC power cable, the low voltage power signal, and the data input signal to an LED fixture;

receiving the low voltage power signal and the data input signal at a circuit board disposed within the LED fixture, wherein the circuit board comprises an LED assembly disposed thereon;

powering and controlling the LED assembly with the low voltage power signal and the data signal; and connecting the power supply module with the LED light assembly, wherein after being connected, there is no visible cabling between the power supply module and the LED light assembly.

2. The method of claim 1, further comprising:

amplifying the data signal with the power supply unit; and transmitting the data signal to another power supply module.

3. The method of claim 1, further comprising:

amplifying the data signal with the power supply unit; and transmitting the data signal to another LED fixture.

4. The method of claim 1, further comprising:

routing the AC power cable through the LED fixture; and connecting the AC power cable to another power supply module.

5. The method of claim 1, further comprising:

routing the AC power cable through the LED fixture; and connecting the AC power cable to another LED fixture.

6. The method of claim 1 wherein the AC power cable is electrically isolated from the circuit board.

7. The method of claim 1 wherein the low voltage power supply line routes through the power supply module and the LED fixture.

8. The method of claim 7 wherein the power supply module and the LED fixture are electrically coupled.

9. A method of transmitting data and power within an LED lighting system, the method comprising:

receiving an AC power input, a low voltage power signal, and a data signal at a power supply module;

connecting the AC power input and the low voltage power signal to a power supply unit disposed within the power supply module;

splitting the AC power input into an AC power cable and an AC power signal;

powering the power supply unit with the AC power signal;

amplifying the low voltage power signal with the power supply unit;

connecting the AC power cable, the low voltage power signal, and the data signal to an LED fixture;

receiving the low voltage power signal and the data signal at a circuit board disposed within the LED fixture, wherein the circuit board comprises an LED assembly disposed thereon;

powering and controlling the LED assembly with the low voltage power signal and the data signal;

enclosing the power supply module in a first enclosure, physically separate from a second enclosure of the LED fixture; and coupling the first enclosure to the second enclosure without using cabling between the enclosures.

10. The method of claim 9 comprising:

passing the data signal through LED fixture unaltered.

11. The method of claim 9:

wherein the coupling the first enclosure to the second enclosure without using cabling between the enclosures comprises:

when the first and second enclosures are coupled together, there are no exposed cables between the enclosures.

12. The method of claim 11 wherein the AC power cable is electrically isolated from the circuit board, the low voltage power signal, and the data signal.

13. The method of claim 11 wherein the data signal is electrically isolated from the power supply unit and the AC power cable.

14. The method of claim 9 wherein the first enclosure comprises output connections for the AC power cable, low voltage power signal, and data signal that couple to corresponding input connections of the second enclosure.

15. The method of claim 9 wherein the LED fixture is an extrusion LED tube fixture.

16. The method of claim 9 wherein the LED fixture operates on DC power.

17. The method of claim 9 wherein there are at least two LED fixtures.

18. The method of claim 9 wherein the low voltage power signal is DC power.

19. The method of claim 9 comprising:

connecting the AC power cable, the low voltage power signal, and the data signal to a second LED fixture;

receiving the low voltage power signal and the data signal at a second circuit board disposed within the second LED fixture, wherein the second circuit board comprises a second LED assembly disposed thereon; and powering and controlling the second LED assembly with the low voltage power signal and the data signal.

20. The method of claim 19 wherein the low voltage power signal is connected to the first and second LED fixtures without passing through any LEDs.

21. The method of claim 19 wherein the low voltage power output is DC power.

22. An LED lighting system, comprising:

a first power supply module, comprising a first power supply unit and an AC power cable;

a data signal line routed through the first power supply module;

an AC power input that is electrically connected to the first power supply unit and the AC power cable; and an LED fixture electrically connected to an output of the first power supply unit and electrically connected to the data input cable, comprising:

one or more LEDs disposed upon a circuit board;

a data signal output a power output, wherein the AC power cable is routed through the LED fixture;

a second power supply module, comprising a second power supply unit and the AC power cable;

the data signal line routed through the second power supply module; and the AC power input that is electrically connected to the second power supply unit and the AC power cable, wherein the first power supply module is electrically coupled to a first end of the LED fixture while the second power supply module is electrically coupled to a second end of the LED fixture.

23. The system of claim 22 wherein the first and second ends of the LED fixture are opposite ends of the LED fixture.

24. The system of claim 22 wherein the second power supply module is configured to amplify a data signal transmitted on the data signal line.

25. The system of claim 22 wherein the LEDs operate on a DC power supply.

26. The system of claim 22 wherein the first power supply is in a first enclosure, physically separate from a second enclosure of the LED fixture.

27. The system of claim 26 wherein the first enclosure to the second enclosure are adapted to be coupled together without using cabling between the enclosures.

28. The system of claim 26 wherein there is no intervening circuitry between the first and second enclosures.

29. The system of claim 22 wherein the LEDs are an extrusion type LED.

30. A method of transmitting data and power within an LED lighting system, the method comprising:

receiving an AC power input and a data input signal at a power supply module;

within the power supply module, splitting the AC power input into an AC power cable and an AC power signal;

connecting the AC power signal to a power supply unit disposed within the power supply module;

generating a low voltage power signal from the AC power signal with the power supply unit;

connecting the AC power cable, the low voltage power signal, and the data input signal to an LED fixture;

receiving the low voltage power signal and the data input signal at a circuit board disposed within the LED fixture, wherein the circuit board comprises an LED assembly disposed thereon; and powering and controlling the LED assembly with the low voltage power signal and the data signal, wherein the LED fixture is rectangular, longer in a length direction than in a width direction, and a connector for the LED fixture has prongs extending transverse to the length direction.

* * * * *